US010770840B1

(12) United States Patent
Garver et al.

(10) Patent No.: US 10,770,840 B1
(45) Date of Patent: Sep. 8, 2020

(54) SHIELDED ELECTRICAL CONNECTOR ASSEMBLY

(71) Applicant: Aptiv Technologies Limited, St. Michael (BB)

(72) Inventors: Erika M. Garver, Southinton, OH (US); Crystal F. Krompegel, Canfield, OH (US); James M. Rainey, Warren, OH (US); John Kountz, Youngstown, OH (US); Jared Bilas, North Bloomfield, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/441,847

(22) Filed: Jun. 14, 2019

(51) Int. Cl.

| | |
|---|---|
| ***H01R 9/05*** | (2006.01) |
| ***H01R 13/6592*** | (2011.01) |
| ***H01R 43/26*** | (2006.01) |
| ***H01R 43/16*** | (2006.01) |
| ***H01R 13/6582*** | (2011.01) |

(52) U.S. Cl.
CPC ..... *H01R 13/6592* (2013.01); *H01R 13/6582* (2013.01); *H01R 43/16* (2013.01); *H01R 43/26* (2013.01)

(58) Field of Classification Search
CPC ..... H01R 13/6592; H01R 43/16; H01R 13/6582; H01R 24/44; H01R 9/0521; H01R 13/59; H01R 13/6272; H01R 24/50; H01R 9/0527
USPC ..... 439/578
See application file for complete search history.

(56) References Cited

U.S. PATENT DOCUMENTS

| | | | | |
|---|---|---|---|---|
| 3,366,920 | A * | 1/1968 | Laudig | H01R 24/44 439/581 |
| 6,273,741 | B1 * | 8/2001 | Schultz | H01R 13/6272 439/358 |
| 6,517,379 | B2 | 2/2003 | Leve | |
| 6,648,683 | B2 * | 11/2003 | Youtsey | H01R 9/0527 439/578 |
| 7,097,499 | B1 * | 8/2006 | Purdy | H01R 9/0521 439/578 |
| 7,357,671 | B2 * | 4/2008 | Wild | H01R 9/0521 439/583 |

(Continued)

FOREIGN PATENT DOCUMENTS

| | | |
|---|---|---|
| EP | 3163690 A1 | 5/2017 |
| WO | 2014111135 A1 | 7/2014 |

*Primary Examiner* — Jean F Duverne
(74) *Attorney, Agent, or Firm* — Billion & Armitage; Robert Myers

(57) ABSTRACT

A shielded electrical connector assembly is presented herein. The shielded electrical connector assembly includes a shield terminal having an attachment portion configured to be connected to a shield conductor of a coaxial cable and a connection portion configured to be received within a mating shield terminal and a contact cage surrounding a forward segment of the connection portion and slideably attached to the shield terminal. The contact cage defines a plurality of arcuate contact arms configured to be in intimate compressive contact with a mating shield terminal inner wall which causes the contact cage to extend rearwardly when the shield terminal is inserted within the mating shield terminal. Methods of forming and interconnecting a shielded electrical connector assembly are also presented herein.

20 Claims, 8 Drawing Sheets

(56) References Cited

U.S. PATENT DOCUMENTS

2001/0051448 A1* 12/2001 Gonzales ..... H01R 24/50
439/63
2004/0198087 A1* 10/2004 Lin ..... H01R 13/59
439/321

* cited by examiner

SHIELDED ELECTRICAL CONNECTOR ASSEMBLY

TECHNICAL FIELD OF THE INVENTION

The invention generally relates to a shielded electrical connector assembly.

BACKGROUND OF THE INVENTION

Shielded electrical connector assemblies have been used for numerous automotive applications, such as navigation systems, infotainment systems, air bag systems, and other data transmission systems. Coaxial cables typically consist of an outer shield conductor, an inner center conductor, a dielectric, and an insulation jacket. The outer conductor and the inner conductor of the coaxial cable often electrically interface with a mating coaxial cable through a coaxial connector assembly.

Shielded electrical connector assemblies, hereinafter referred to as shielded connectors, are often used to connect coaxial cables while providing a certain degree of electromagnetic shielding. The use of shielded connectors has greatly increased in automotive applications as devices requiring coaxial cable high for speed data communication continue to proliferate.

The use of shielded connectors for automotive usage has become so common that standards for signal loss and contact resistance have been devised. Some shielded connectors that meet these specifications use high cost cold drawn tubular shield terminals.

Shielded connectors need to have sufficient electrical contact between the mating shield terminals to provide adequate shielding, i.e. improper contacts between the shield terminals can allow significant RF leakage. Thus, shielded connectors use features, such as lances, i.e. cantilevered contacts cut from the shield terminals or copper rings to provide electrical contact between the shield terminals. However, the openings in the shield terminals caused by forming the lances increase RF leakage and the copper rings increase connector insertion force to levels that make assembling the shielded connectors difficult.

Therefore, a low cost shielded connector which meets all performance specifications remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment of the invention, a shielded electrical connector assembly is provided. The shielded electrical connector assembly includes a shield terminal having an attachment portion configured to be connected to a shield conductor of a coaxial cable and a connection portion configured to be received within a mating shield terminal. The shielded electrical connector assembly further includes a contact cage surrounding a forward segment of the connection portion and slideably attached to the shield terminal. The contact cage defines a plurality of arcuate contact arms configured to be in intimate compressive contact with a mating shield terminal inner wall when the shield terminal is inserted within the mating shield terminal. As used herein, forward refers to a direction toward the end of the connection portion that is inserted within the mating shield terminal and rearward refers to a direction that is away from the end of the connection portion that is inserted within the mating shield terminal. The compressive contact of the plurality of arcuate contact arms with the mating shield terminal inner wall causes the contact cage to extend rearwardly when the shield terminal is inserted within the mating shield terminal.

In an example embodiment having one or more features of the shielded electrical connector assembly of the previous paragraph, a forward end of the contact cage is fixedly attached to the forward segment and a rearward end of the contact cage is slideably attached.

In an example embodiment having one or more features of the shielded electrical connector assembly of the previous paragraph, the forward end of the contact cage is rounded.

In an example embodiment having one or more features of the shielded electrical connector assembly of the previous paragraph, the forward end of the contact cage covers a leading edge of the connection portion.

In an example embodiment having one or more features of the shielded electrical connector assembly of the previous paragraph, the shielded electrical connector assembly further includes the coaxial cable which has the shield conductor surrounding a central conductor. The shield conductor is connected to the shield terminal. The shielded electrical connector assembly also includes a central conductor terminal disposed within the inner insulator and connected to the central conductor.

In an example embodiment having one or more features of the shielded electrical connector assembly of the previous paragraph, the shielded electrical connector assembly further includes an inner insulator disposed within the shield terminal. A side wall of the forward segment defines an inspection aperture configured to allow visual verification of proper seating of the central terminal within the inner insulator and/or shield terminal.

According to another embodiment of the invention, a shielded electrical connector assembly is provided. The shielded electrical connector assembly includes a shield terminal formed of a first electrically conductive material having an attachment portion configured to attach to a shield conductor of a coaxial cable and a connection portion configured to be received within a mating shield terminal and a contact cage formed of a second electrically conductive material having a forward band, a rearward band and a plurality of longitudinally arranged arcuate contact arms extending from the forward band to the rearward band. The contact cage is slideably attached to the shield terminal by a tab extending from the forward band that is folded into an opening in the connection portion and by a cantilevered tab extending from a side wall of the connection portion. The cantilevered tab is configured to inhibit forward motion of the rearward band.

In an example embodiment having one or more features of the shielded electrical connector assembly of the previous paragraph, the contact cage includes a plurality of tabs extending from the forward band that are folded into the opening in the connection portion. The folded regions of the plurality of tabs have a rounded shape.

In an example embodiment having one or more features of the shielded electrical connector assembly of the previous paragraph, the shielded electrical connector assembly further includes an inner insulator disposed within the shield terminal. The side wall of the connection portion defines an inspection aperture.

In an example embodiment having one or more features of the shielded electrical connector assembly of the previous paragraph, the plurality of tabs is a first plurality of tabs. The contact cage also includes a second plurality of tabs extending from the forward band that are folded into the inspection aperture.

In an example embodiment having one or more features of the shielded electrical connector assembly of the previous paragraph, the contact cage has a generally cylindrical shape. A first gap is defined in the forward band and a second gap is defined in the rearward band.

In an example embodiment having one or more features of the shielded electrical connector assembly of the previous paragraph, the first gap is longitudinally aligned with the second gap.

According to yet another embodiment of the invention, a method of forming a shielded electrical connector assembly is provided. The method includes the steps of forming a shield terminal formed of a first electrically conductive material having an attachment portion configured to attach to a shield conductor of a coaxial cable and a connection portion configured to be received within a mating shield terminal and forming a contact cage formed of a second electrically conductive material having a forward band, a rearward band, a plurality of longitudinally arranged arcuate contact arms extending from the forward band to the rearward band, and a first plurality of tabs extending from the forward band.

In an example embodiment having one or more features of the method of the previous paragraph, the method further includes the steps of cutting a shield terminal preform from a first sheet of electrically conductive material, forming the shield terminal preform into the shield terminal, forming a cantilevered tab extending from a side wall of the connection portion, cutting a contact cage preform from a second sheet of electrically conductive material, forming the contact cage preform into the contact cage, and slideably attaching the contact cage to the shield terminal by folding the first plurality of tabs into an opening in the connection portion and sliding the rearward band past the cantilevered tab.

In an example embodiment having one or more features of the method of the previous paragraph, the folded regions of the first plurality of tabs have a rounded shape.

In an example embodiment having one or more features of the method of the previous paragraph, the method further includes the step of forming an inspection aperture in the side wall of the connection portion.

In an example embodiment having one or more features of the method of the previous paragraph, the contact cage includes a second plurality of tabs extending from the forward band and the method further includes the step of folding the second plurality of tabs into the inspection aperture.

In an example embodiment having one or more features of the method of the previous paragraph, the contact cage is formed into a generally cylindrical shape and wherein a first gap is defined in the forward band and a second gap is defined in the rearward band.

In an example embodiment having one or more features of the method of the previous paragraph, the first gap is longitudinally aligned with the second gap.

In an example embodiment having one or more features of the method of the previous paragraph, compression of the plurality of contact arms causes the contact cage to extend rearwardly.

According to one more embodiment of the invention, a method of interconnecting a shielded electrical connector assembly is provided. The method includes the step of providing a shielded electrical connector including a shield terminal having an attachment portion configured to be connected to a shield conductor of a first coaxial cable and a connection portion, the shielded electrical connector further including a contact cage surrounding a forward segment of the connection portion and slideably attached to the shield terminal. The contact cage defines a plurality of arcuate contact arms. The method also includes the steps of providing a mating shielded electrical connector having a mating shield terminal configured to receive the connection portion of the shield terminal and inserting the connection portion of the shield terminal into the mating shield terminal such that the plurality of arcuate contact arms are in intimate compressive contact with a mating shield terminal inner wall. The compressive contact of the plurality of arcuate contact arms with the mating shield terminal inner wall causes the contact cage to extend rearwardly when the shield terminal is inserted within the mating shield terminal.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
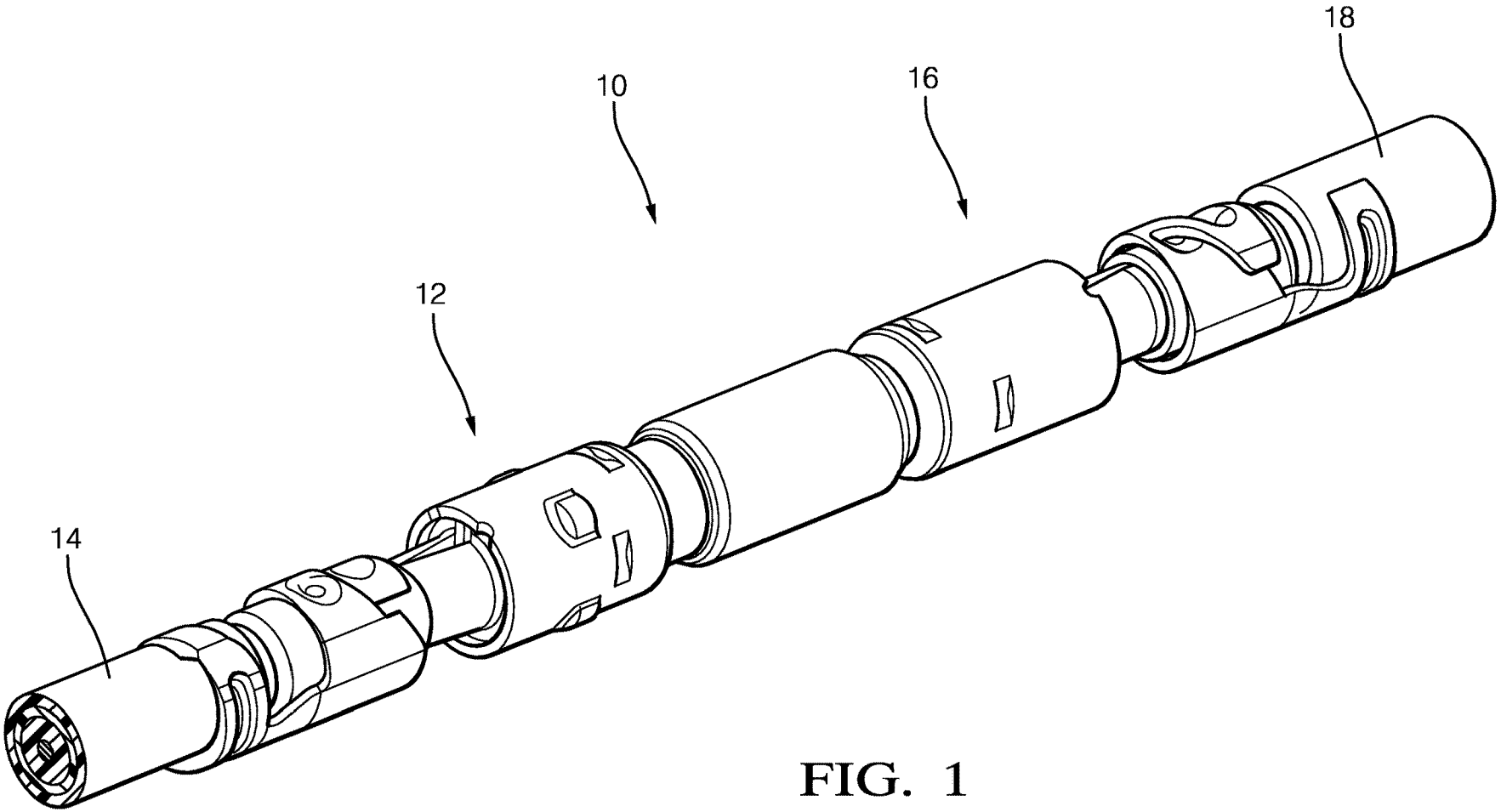
FIG. 1 is a perspective view of a shielded electrical connector assembly in a connected state according to one embodiment of the invention.
Figure 2:
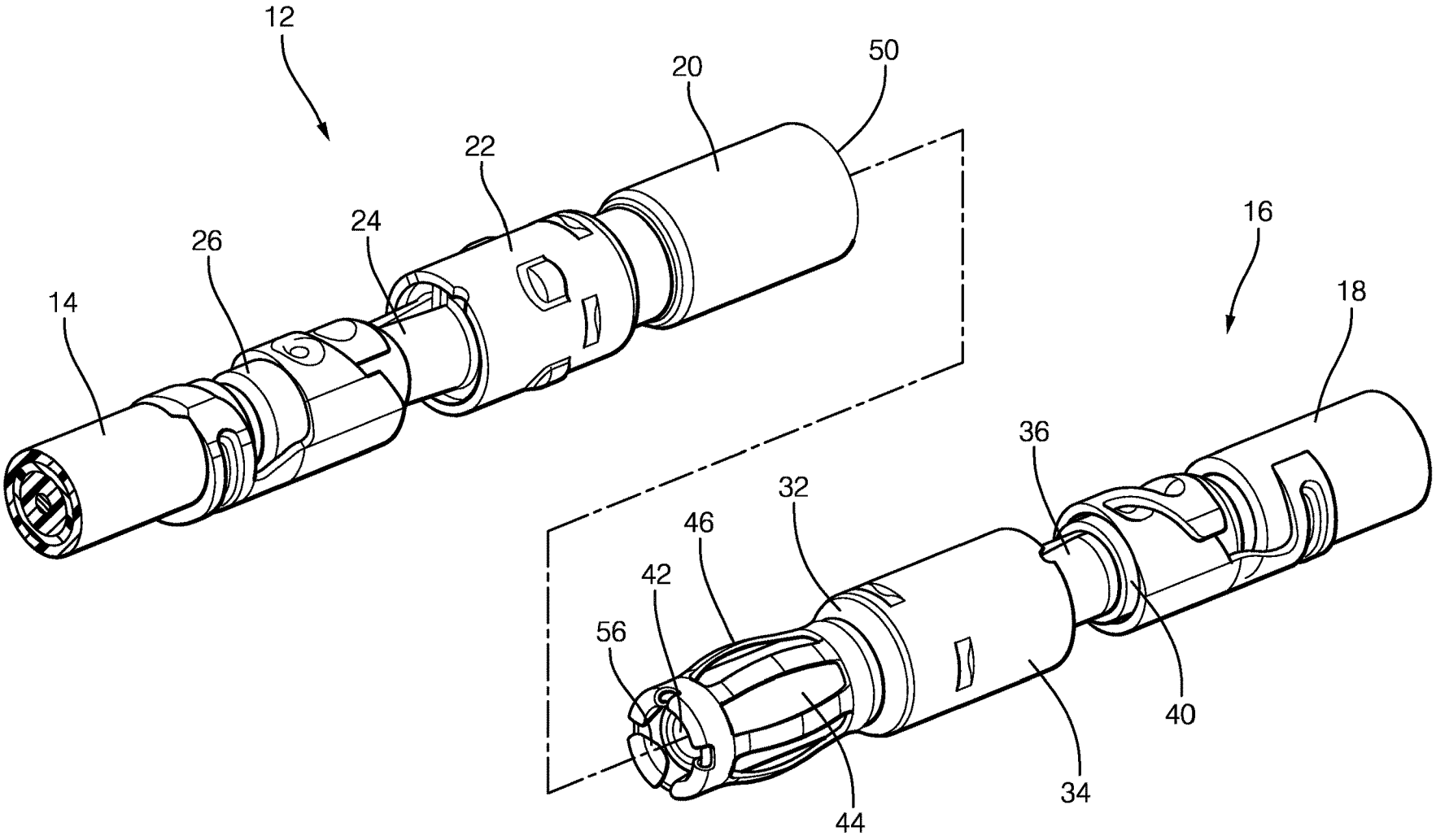
FIG. 2 is a perspective view of the shielded electrical connector assembly of FIG. 1 in a disconnected state according to one embodiment of the invention.

FIGS. 1-6 illustrate a non-limiting example of a shielded electrical connector assembly according to one or more embodiments of the invention. The example shielded electrical connector assembly, hereinafter referred to as the assembly 10, is used to interconnect coaxial cables, such as those used to transmit high speed digital data. FIG. 1 shows the assembly 10 in a connected state and FIG. 2 shows the assembly 10 in a disconnected state.

As best shown in FIG. 2, the assembly 10 includes a male connector assembly, hereinafter referred to as the male connector 12, terminating a first coaxial cable 14 and a female connector assembly, hereinafter referred to as the female connector 16, terminating a second coaxial cable 18. The male connector 12 includes a male pin terminal (not shown) connected to the center conductor (not shown) of the first coaxial cable 14 and a female shield terminal 20 that longitudinally surrounds the male pin terminal. An attachment portion 22 of the female shield terminal 20 is mechanically and electrically connected a first inner ferrule 24 that is in contact with the shield conductor (not shown) of the first coaxial cable 14. The first inner ferrule 24 is secured to the first coaxial cable 14 by a first outer ferrule 26. The first inner ferrule 24 is crimped to the first outer ferrule 26 by a first crimping sleeve that includes crimping wings that attach the first crimping sleeve to the insulative jacket of the first coaxial cable 14. The male connector 12 also includes a dielectric insulator (not shown) between the male pin terminal and the female shield terminal 20.

As best shown in FIGS. 2-5, the female connector 16 includes a female socket terminal 28 connected to the center conductor 30 of the second coaxial cable 18 and a male shield terminal 32 that longitudinally surrounds the female socket terminal 28. An attachment portion 34 of the male shield terminal 32 is mechanically and electrically connected a second inner ferrule 36 that is in contact with the shield conductor 38 of the second coaxial cable 18. The second inner ferrule 36 is secured to the second coaxial cable 18 by a second outer ferrule 40. The second inner ferrule 36 is crimped to the second outer ferrule 40 by a second crimping sleeve that includes crimping wings that attach the second crimping sleeve to the insulative jacket of the second coaxial cable 18. The female connector 16 also includes a dielectric insulator 42 between the female socket terminal 28 and the male shield terminal 32. As shown in FIG. 1, a connection portion 44 of the male shield terminal 32 of the female connector 16 is configured to be received within the female shield terminal 20 of the male connector 12. The female connector 16 further includes a contact cage 46 that surrounds a forward segment of the connection portion 44. The contact cage 46 is slideably attached to the male shield terminal 32, i.e., although the contact cage 46 is attached to the connection portion 44, at least a portion of the contact cage 46 is free to move and slide along the contact portion. The contact cage 46 defines a plurality of arcuate contact arms 48 that are configured to be in intimate compressive contact with an inner wall 50 of the female shield terminal 20 when the male shield terminal 32 is inserted within the female shield terminal 20. The compressive contact of the plurality of arcuate contact arms 48 with the inner wall 50 causes the contact cage 46 to extend rearwardly when the male shield terminal 32 is inserted within the female shield terminal 20.

As used herein, the designation male or female connector is based on the gender of the terminal connected to the center conductor of the coaxial cable to which the connector is attached. In alternative embodiments, the male connector may include a male shield terminal surrounding a male pin terminal and the female connector may have female shield terminal surrounding a female socket terminal. Additionally, in alternative embodiments, the male and/or female contactor may terminate other circuit elements, such as conductive traces on a printed circuit board.

Figure 3:
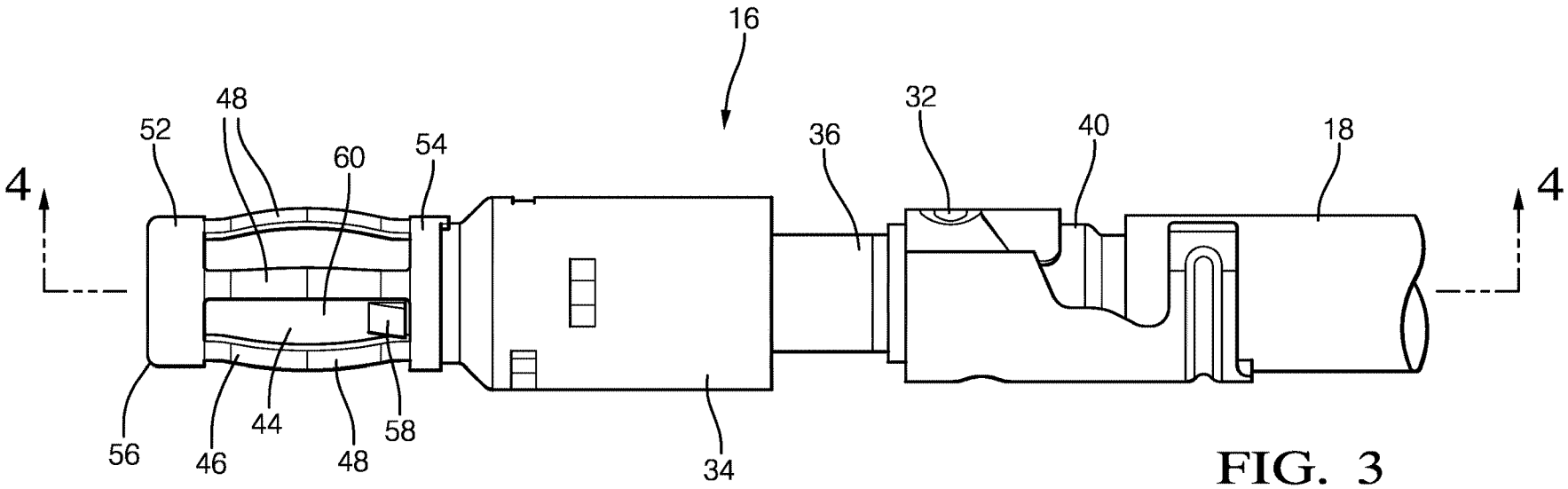
FIG. 3 is a side view of a shielded electrical connector of the shielded electrical connector assembly of FIG. 1 according to one embodiment of the invention.
Figure 4:
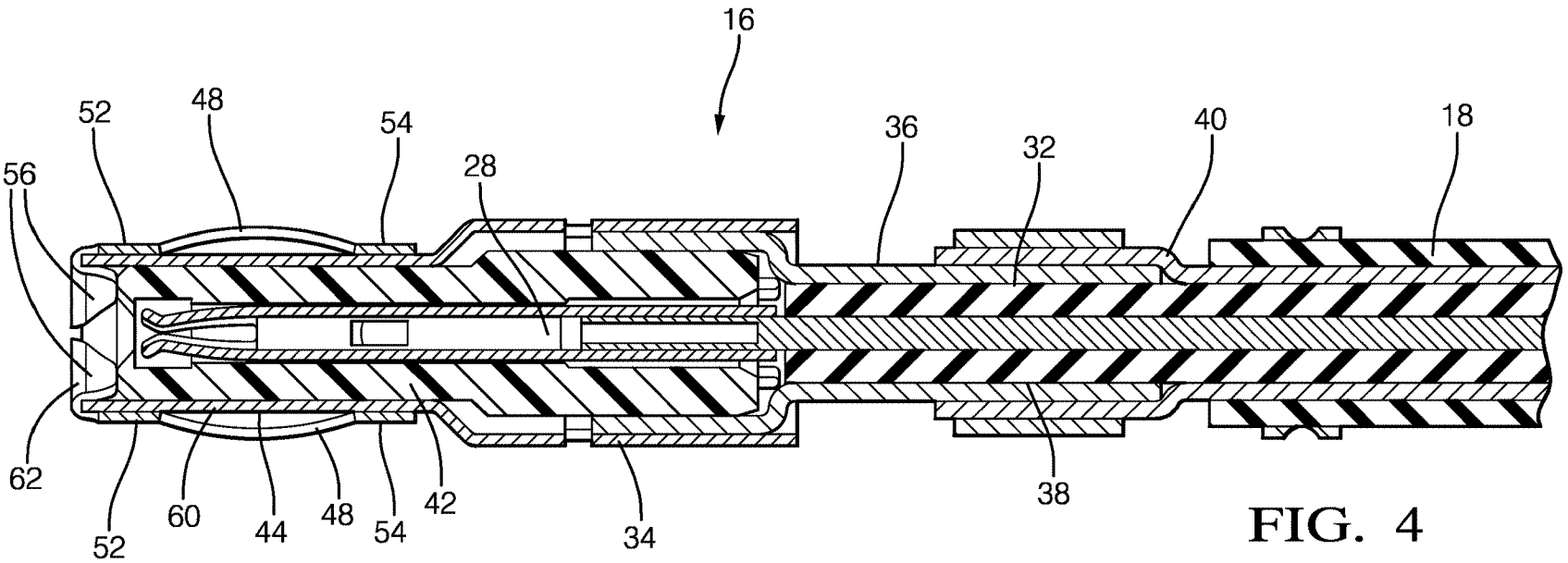
FIG. 4 is a cross section end view of the shielded electrical connector of FIG. 3 according to one embodiment of the invention.
Figure 5:
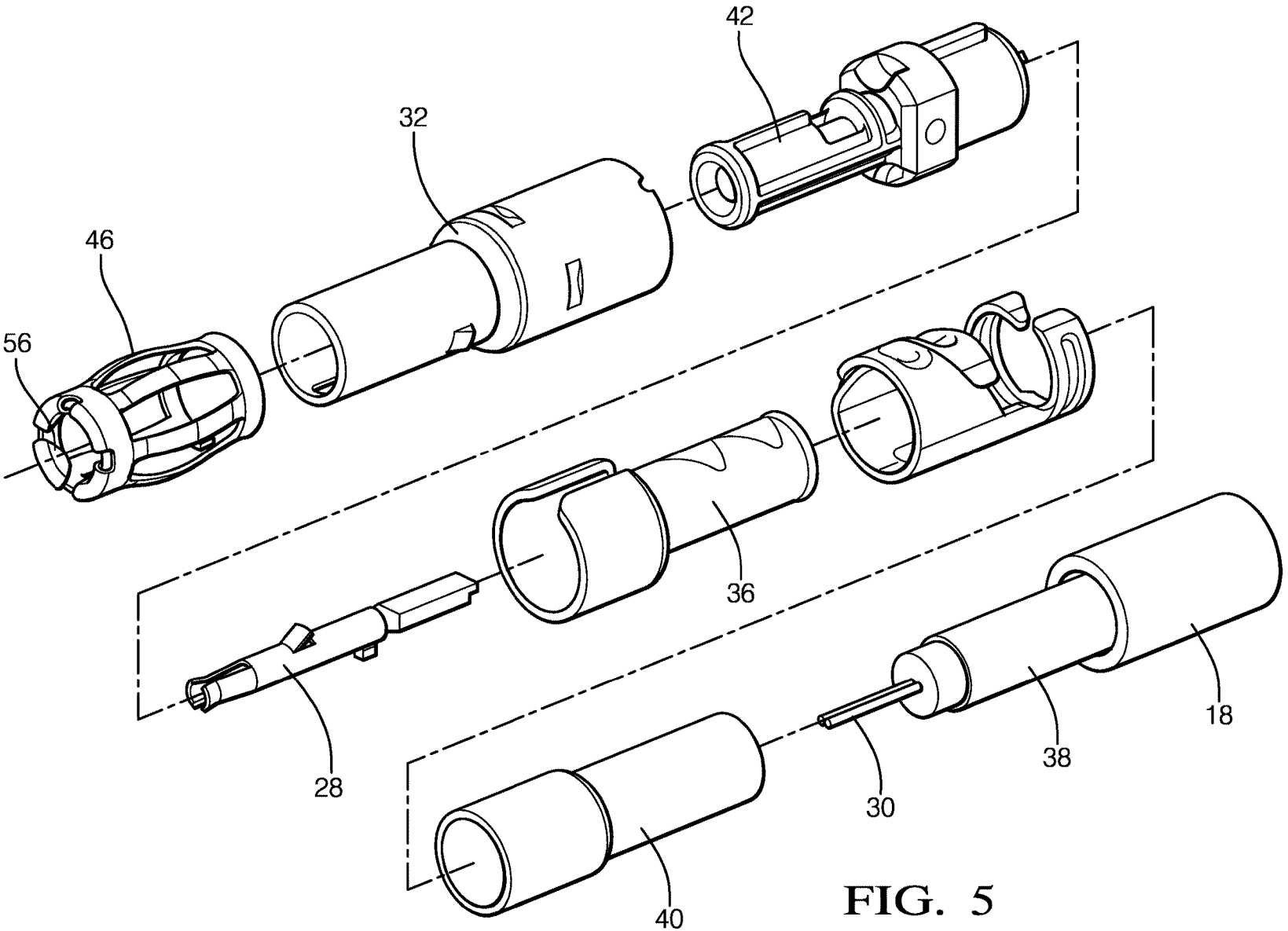
FIG. 5 is an exploded view of the shielded electrical connector of FIG. 3 according to one embodiment of the invention.

Focusing now on the female connector 16 shown in FIGS. 3-5, the male shield terminal 32 formed of a first electrically conductive material, such as a plated copper material. The contact cage 46 is formed of a second electrically conductive material, such as 301½ hard tempered stainless steel. The contact cage 46 has a forward band 52, a rearward band 54 and the plurality of longitudinally arranged arcuate contact arms 48 that extend from the forward band 52 to the rearward band 54. The forward band 52 of the contact cage 46 is fixedly attached to the male shield terminal 32 by a first plurality of tabs 56 extending from the forward band 52 that is folded into an opening in the connection portion 44 and by a cantilevered tab 58 extending from a side wall 60 of the connection portion 44. Folded regions 62 of the plurality of tabs 56 have a rounded shape over the forward end of the male shield terminal 32. The rounded ends of the folded regions 62 provide the benefit of allowing the male shield terminal 32 to be used in a sealed application with a reduced likelihood of tearing a seal as the male shield terminal 32 is inserted through the seal. A rearward edge 64 of the cantilevered tab 58 extends above the outer wall of the connection portion 44 and engages the rearward band 54. This engagement of the cantilevered tab 58 with the rearward band 54 inhibits forward motion of the contact cage 46 along the connection portion 44 while allowing the rearward band 54 to move in a rearward direction along the connection portion 44 due to compression of the contact arms 48 when the male terminal shield is inserted within the female shield terminal 20.

Alternative embodiments of the assembly may be envisioned in which a single tab extending from the forward band 52 is folded into the opening in the connection portion 44 to attach the contact cage 46 to the male shield terminal.

Figure 6:
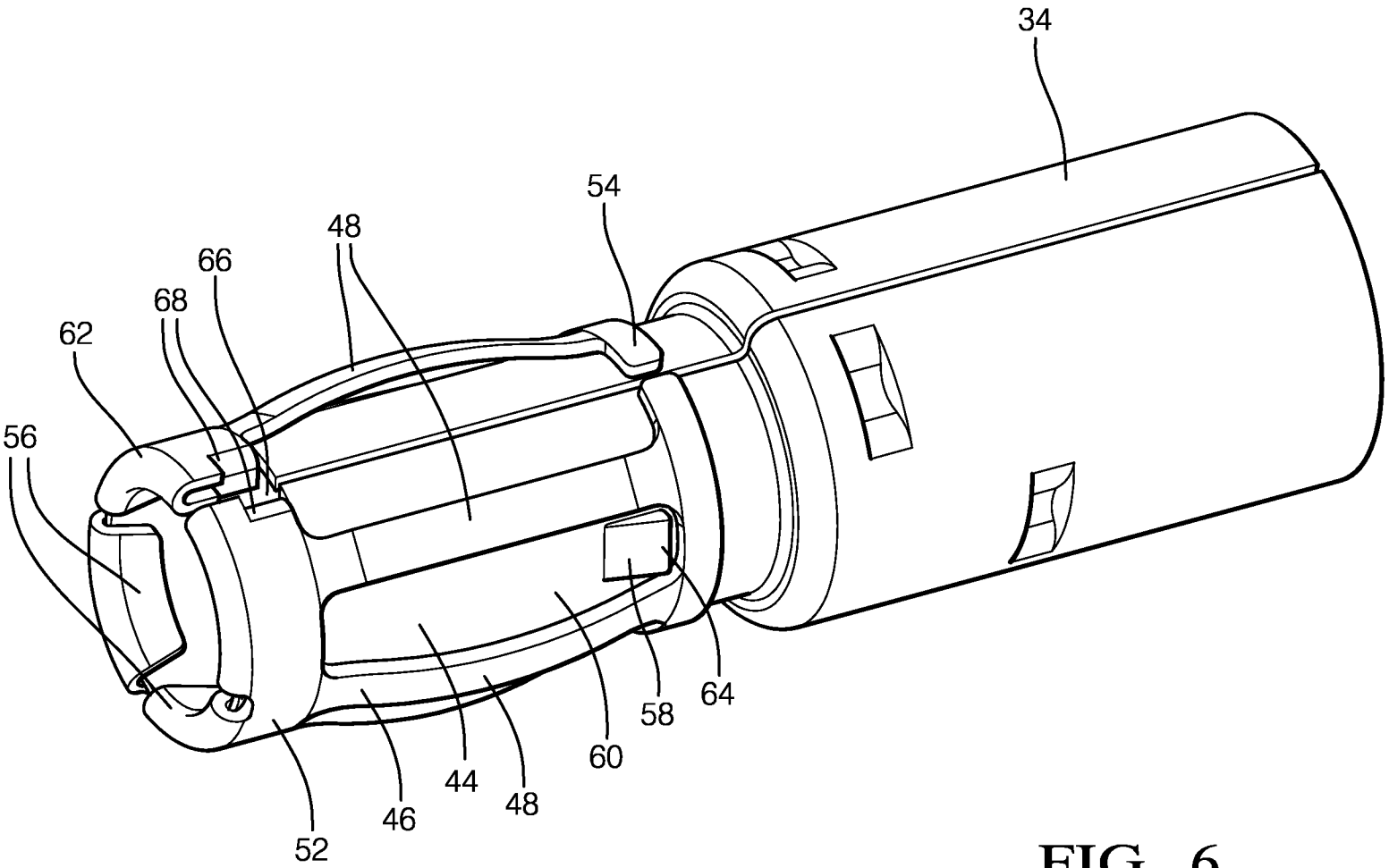
FIG. 6 is an isolated perspective view of a shield terminal and a contact cage of the shielded electrical connector of FIG. 3 according to one embodiment of the invention.

As best shown in FIG. 6, the side wall 60 of the connection portion 44 defines an inspection aperture 66 that allows visual inspection for proper placement of the female socket terminal 28 within the dielectric insulator 42 and male shield terminal 32. Visual inspection of placement of the female socket terminal may be performed manually, e.g. by a human assembly operator, or automatically, e.g. by a machine vision system.

As illustrated in FIG. 6, the contact cage 46 also has a second plurality of tabs 68 that extend from the forward band 52 that are folded into the inspection aperture 66. The second plurality of tabs 68 are configured to further hinder forward motion of the contact cage 46 relative to the connection portion 44 once these tabs 68 are folded into the inspection aperture 66. The second plurality of tabs 68 also inhibit rotational movement of the contact cage 46 around the connection portion 44.

The contact cage 46 has a generally cylindrical shape. A first gap is defined in the forward band 52 and a second gap is defined in the rearward band 54. The first gap is longitudinally aligned with the second gap.

Although the example of the assembly 10 presented herein has a straight, i.e. 180 degree, connection orientation between the first and second coaxial cables, other embodiments of the assembly may be envisioned with different connection orientation between the first and second coaxial cables, particularly a right angle, i.e. 90 degree, connection orientation.

Figure 7:
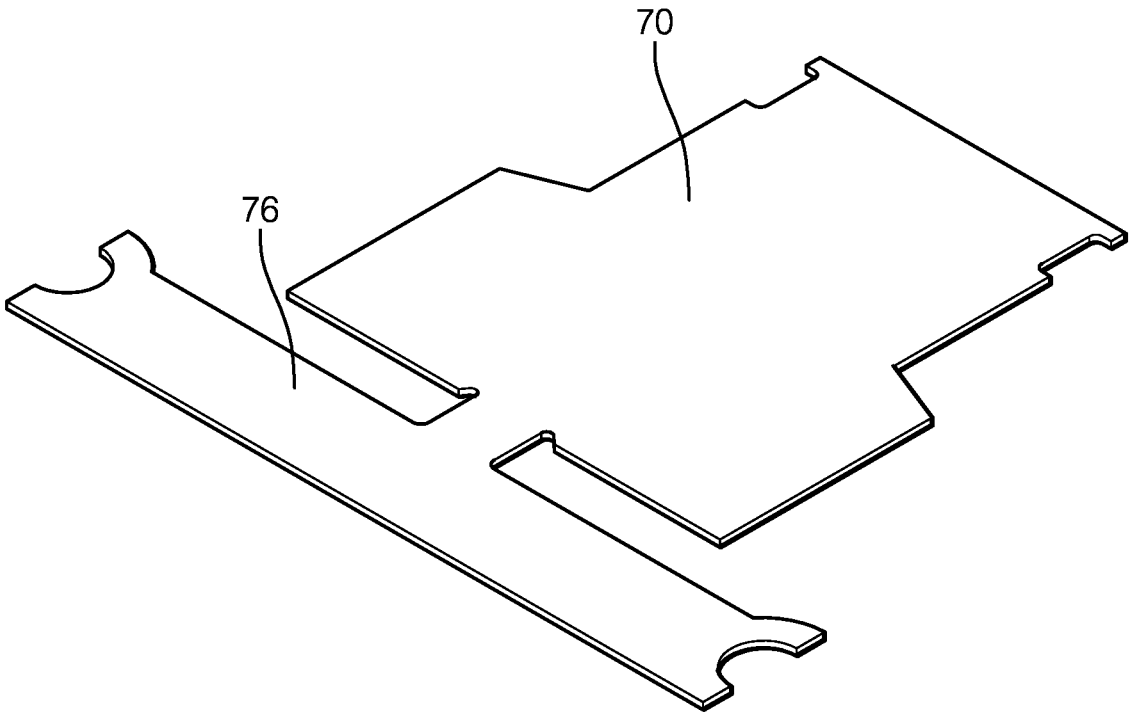
FIG. 7 is a perspective view of a shield terminal preform of the shielded electrical connector of FIG. 3 according to one embodiment of the invention.

FIG. 7 illustrates a method 100 of forming a shielded electrical connector assembly, e.g. the assembly 10 described above. The method 100 includes the following steps:

STEP 102, CUT A SHIELD TERMINAL PREFORM FROM A FIRST SHEET OF ELECTRICALLY CONDUCTIVE MATERIAL, includes cutting a shield terminal preform 70 from a first sheet of electrically conductive material. As used herein, the shield terminal preform 70 is a flat workpiece cut from a sheet of electrically conductive material that has all of the geometric features required to form the shield terminal 32 after application of a forming process such as bending, rolling, stretching, spinning, or deep drawing. The shield terminal preform 70 is attached to a first carrier strip 72 integrally formed from the first sheet of electrically conductive material to facilitate handling of the shield terminal preform 70;

STEP 104, FORM THE SHIELD TERMINAL PREFORM INTO A SHIELD TERMINAL HAVING AN ATTACHMENT PORTION CONFIGURED TO ATTACH TO A SHIELD CONDUCTOR OF A COAXIAL CABLE AND A CONNECTION PORTION CONFIGURED TO BE RECEIVED WITHIN A MATING SHIELD TERMINAL, includes forming a shield terminal 32 having an attachment portion 22 configured to attach to a shield conductor 38 of a coaxial cable 18 and a connection portion 44 configured to be received within a mating shield terminal 20;

STEP 106, FORM A CANTILEVERED TAB EXTENDING FROM A SIDE WALL OF THE CONNECTION PORTION, includes forming a cantilevered tab 58 extending from a side wall 60 of the connection portion 44. In the illustrated example, the cantilevered tab 58 is formed prior to STEP 104;

STEP 108, CUT A CONTACT CAGE PREFORM FROM A SECOND SHEET OF ELECTRICALLY CONDUCTIVE MATERIAL, includes cutting a contact cage preform 74 from a second sheet of electrically conductive material. As used herein, the contact cage preform 74 is a flat workpiece cut from a sheet of electrically conductive material that has all of the geometric features required to form the contact cage 46 after application of a forming process such as bending, rolling, stretching, spinning, or deep drawing. The contact cage preform 74 is attached to a second carrier strip 76 integrally formed from the second sheet of electrically conductive material to facilitate handling of the contact cage preform 74;

STEP 110, FORM THE CONTACT CAGE PREFORM A CONTACT CAGE HAVING A FORWARD BAND, A REARWARD BAND, A PLURALITY OF LONGITUDINALLY ARRANGED ARCUATE CONTACT ARMS EXTENDING FROM THE FORWARD BAND TO THE REARWARD BAND, AND A FIRST PLURALITY OF TABS EXTENDING FROM THE FORWARD BAND, includes forming a contact cage 46 having a forward band 52, a rearward band 54, a plurality of longitudinally arranged arcuate contact arms 48 extending from the forward band 52 to the rearward band 54, and a first plurality of tabs 56 extending from the forward band 52;

STEP 112, SLIDEABLY ATTACH THE CONTACT CAGE TO THE SHIELD TERMINAL BY FOLDING THE FIRST PLURALITY OF TABS INTO AN OPENING IN THE CONNECTION PORTION AND SLIDING THE REARWARD BAND PAST THE CANTILEVERED TAB, includes slideably attaching the contact cage 46 to the shield terminal 32 by folding the first plurality of tabs 56 into an opening in the forward end of the connection portion 44 and sliding the rearward band 54 past the cantilevered tab 58;

STEP 114, FORM AN INSPECTION APERTURE IN THE SIDE WALL OF THE CONNECTION PORTION, forming an inspection aperture 66 in the side wall 60 of the connection portion 44. In the illustrated example, the inspection aperture 66 is formed by cutting notches in the edges of the shield terminal preform and bringing the edges together when the shield terminal 32 is formed from the shield terminal preform in STEP 104; and STEP 116, FOLD A SECOND PLURALITY OF TABS INTO THE INSPECTION APERTURE, includes folding the second plurality of tabs 68 into the inspection aperture 66 when the contact cage 46 includes a second plurality of tabs 68 extending from the forward band 52.

Figure 8:
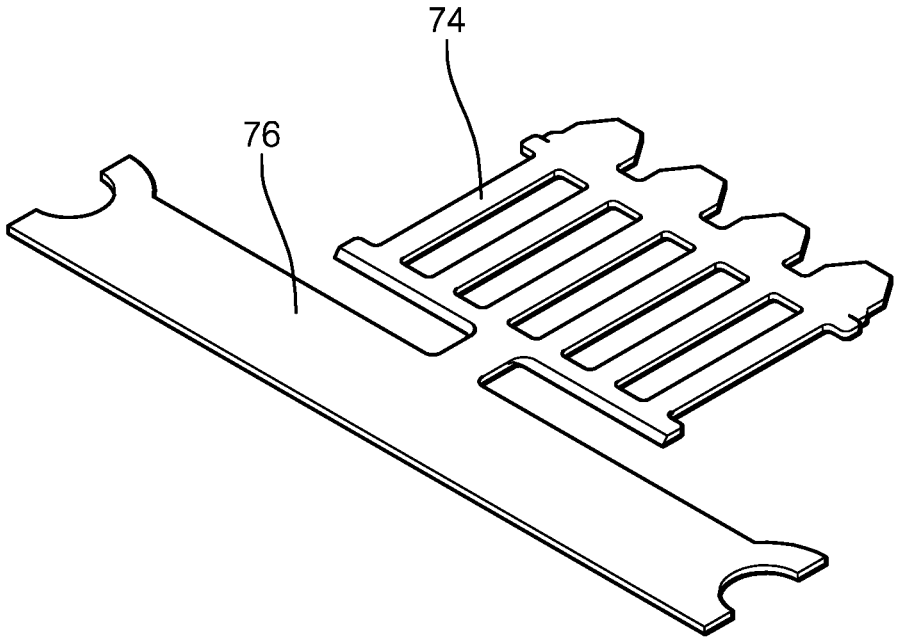
FIG. 8 is a perspective view of a a contact cage preform of the shielded electrical connector of FIG. 3 according to one embodiment of the invention.
Figure 9:
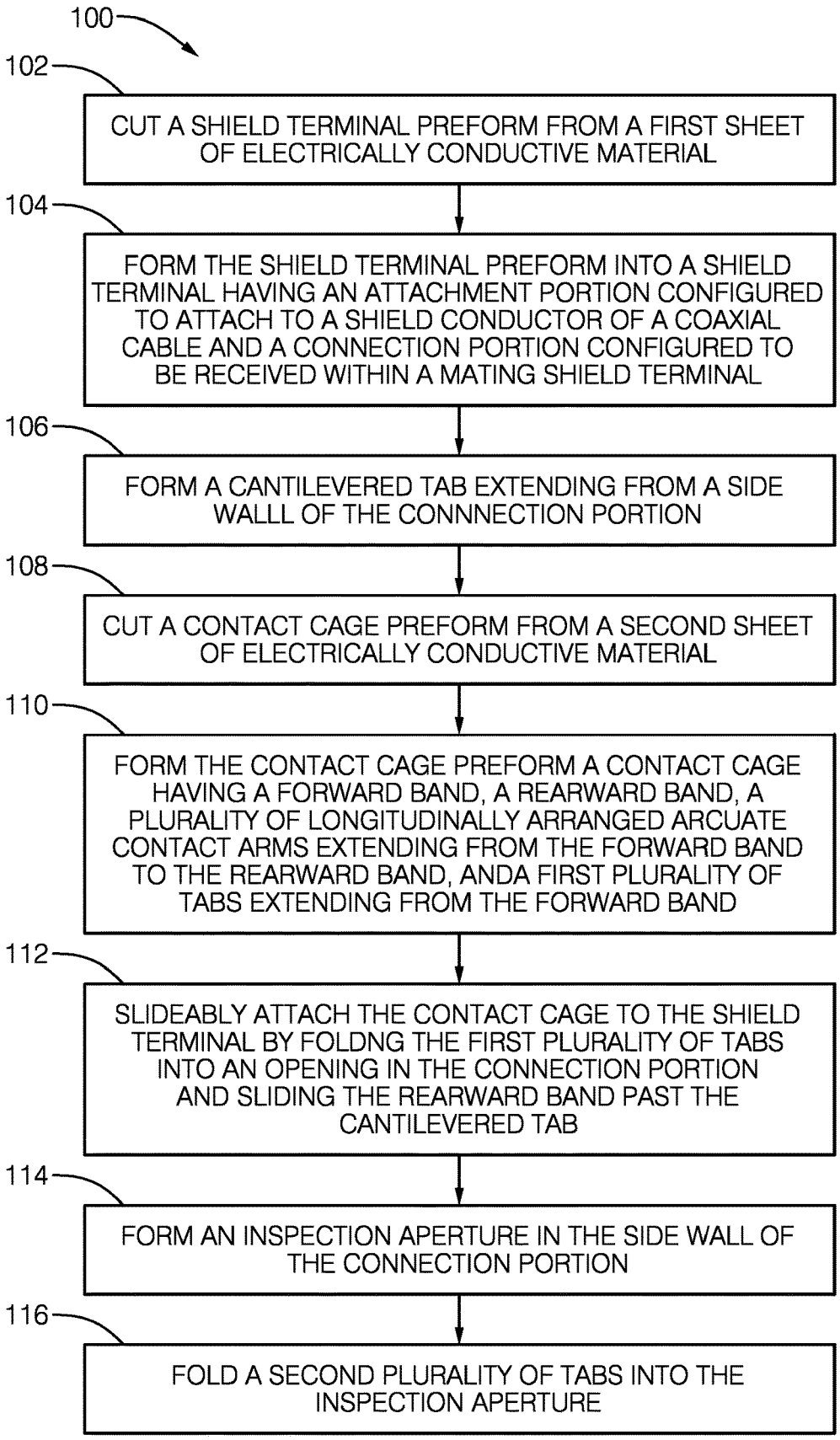
FIG. 9 is a flow chart of a method of forming a shielded electrical connector assembly according to another embodiment of the invention.
Figure 10:
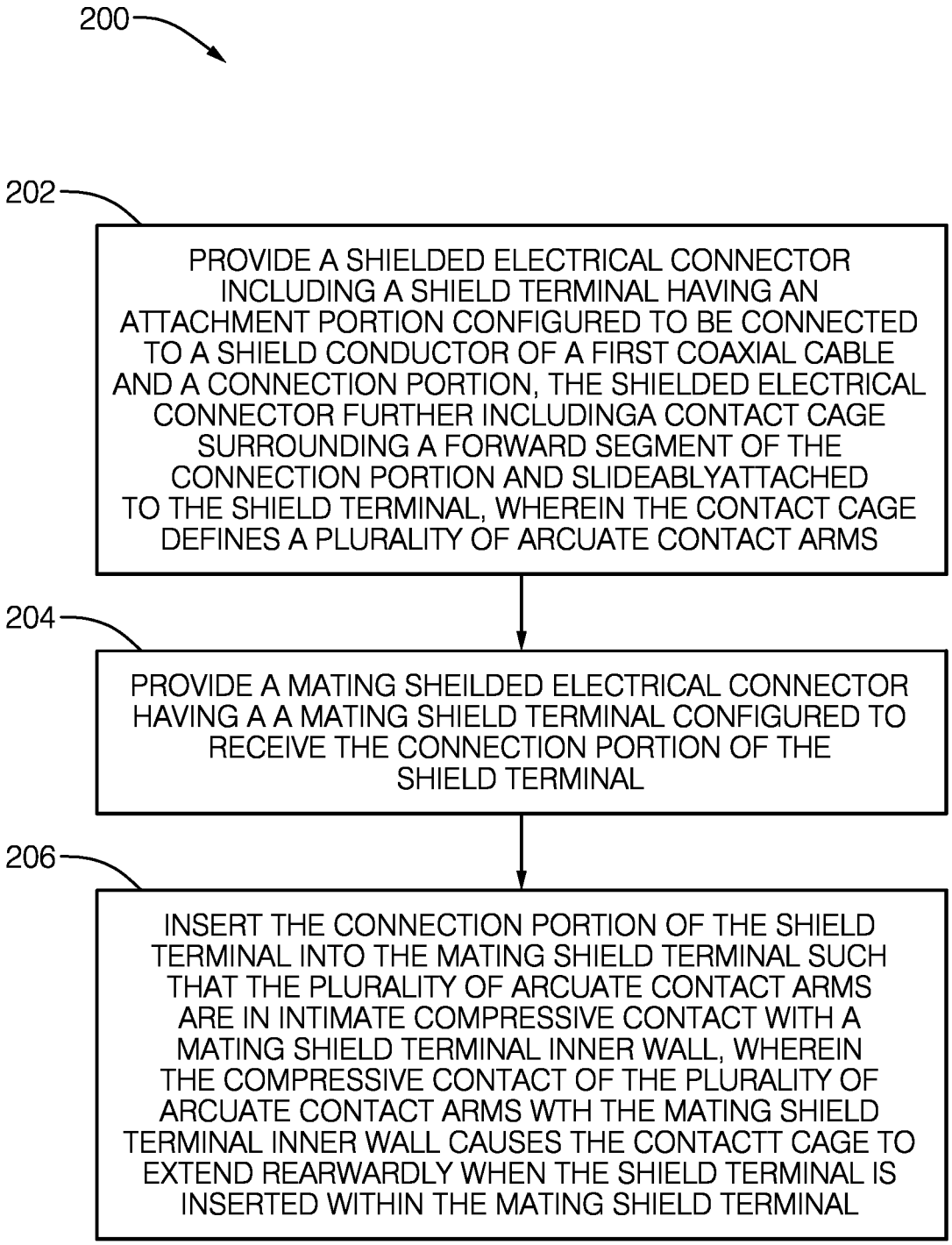
FIG. 10 is a flow chart of a method of interconnecting a shielded electrical connector assembly according to yet another embodiment of the invention.

FIG. 8 illustrates a method 200 of interconnecting a shielded electrical connector assembly, e.g. the assembly 10 described above. The method 200 includes the following steps:

STEP 202, PROVIDE A SHIELDED ELECTRICAL CONNECTOR INCLUDING A SHIELD TERMINAL HAVING AN ATTACHMENT PORTION CONFIGURED TO BE CONNECTED TO A SHIELD CONDUCTOR OF A FIRST COAXIAL CABLE AND A CONNECTION PORTION, THE SHIELDED ELECTRICAL CONNECTOR FURTHER INCLUDING A CONTACT CAGE SURROUNDING A FORWARD SEGMENT OF THE CONNECTION PORTION AND SLIDEABLY ATTACHED TO THE SHIELD TERMINAL, WHEREIN THE CONTACT CAGE DEFINES A PLURALITY OF ARCUATE CONTACT ARMS, includes providing a shielded electrical connector 16 including a shield terminal 32 having an attachment portion 22 configured to be connected to a shield conductor 38 of a first coaxial cable 14 and a connection portion 44. The shielded electrical connector 16 further includes a contact cage 46 surrounding a forward segment of the connection portion 44 and slideably attached to the shield terminal 32. The contact cage 46 defines a plurality of arcuate contact arms 48;

STEP 204, PROVIDE A MATING SHIELDED ELECTRICAL CONNECTOR HAVING A MATING SHIELD TERMINAL CONFIGURED TO RECEIVE THE CONNECTION PORTION OF THE SHIELD TERMINAL, includes providing a mating shielded electrical connector 12 having a mating shield terminal 20 configured to receive the connection portion 44 of the shield terminal 32; and STEP 206, INSERT THE CONNECTION PORTION OF THE SHIELD TERMINAL INTO THE MATING SHIELD TERMINAL SUCH THAT THE PLURALITY OF ARCUATE CONTACT ARMS ARE IN INTIMATE COMPRESSIVE CONTACT WITH A MATING SHIELD TERMINAL INNER WALL, WHEREIN THE COMPRESSIVE CONTACT OF THE PLURALITY OF ARCUATE CONTACT ARMS WITH THE MATING SHIELD TERMINAL INNER WALL CAUSES THE CONTACT CAGE TO EXTEND REARWARDLY WHEN THE SHIELD TERMINAL IS INSERTED WITHIN THE MATING SHIELD TERMINAL, includes inserting the connection portion 44 of the shield terminal 32 into the mating shield terminal 20 such that the plurality of arcuate contact arms 48 are in intimate compressive contact with a mating shield terminal inner wall 50. The compressive contact of the plurality of arcuate contact arms 48 with the inner wall 50 of the mating shield terminal 20 causes the contact cage 46 to extend rearwardly when the shield terminal 32 is inserted within the mating shield terminal 20.

Accordingly, a shielded electrical connector assembly 10, a method 100 of forming a shielded electrical connector assembly 10, and a method 200 of interconnecting a shielded electrical connector assembly 10 is presented. The assembly 10 and methods 100, 100 provide the benefit of reduced engagement force required to mate the male connector 12 with the female connector 16 due to the stainless steel contact cage design. The contact cage 46 is held in place by multiple folded tabs 56 that prevent movement of the contact cage 46 in all directions except for the rearward band 54 which moves horizontally as the contact arms 48 are depressed by contacting the inner wall 50 of the female shield terminal 20. This rearward movement of the rearward band 54 provides a balance between engagement force and contact force during the assembly process. The low permanent set of the stainless steel material forming the contact cage 46 allows the contact arms 48 to be depressed multiple times without deformation. Openings in the male shield terminal 32 are minimal, so radio frequency interference performance is optimized. An inspection aperture 66 in the male shield terminal 32 makes the inner insulator visible to reduce the likelihood that an improperly inserted inner insulator and inner terminal will be undetected. The folded tabs 56 on the leading edge of the female connector 16 allow it to be inserted through seals without tearing the seal.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A shielded electrical connector assembly, comprising:

a shield terminal having an attachment portion configured to be connected to a shield conductor of a coaxial cable and a connection portion configured to be received within a mating shield terminal; and a contact cage surrounding a forward segment of the connection portion, wherein a forward end of the contact cage is fixedly attached to the forward segment and wherein a rearward end of the contact cage is slideably attached to the forward segment, wherein the contact cage defines a plurality of arcuate contact arms configured to be in intimate compressive contact with a mating shield terminal inner wall when the shield terminal is inserted within the mating shield terminal and wherein the compressive contact of the plurality of arcuate contact arms with the mating shield terminal inner wall causes the contact cage to extend rearwardly when the shield terminal is inserted within the mating shield terminal.

2. The assembly according to claim 1, wherein the forward end of the contact cage is rounded.

3. The assembly according to claim 1, wherein the forward end of the contact cage covers a leading edge of the connection portion.

4. The assembly according to claim 1, further comprising an inner insulator disposed within the shield terminal, wherein a side wall of the forward segment defines an inspection aperture configured to allow visual verification of proper seating of the central conductor within the inner insulator.

5. The assembly according to claim 4, wherein the inspection aperture is configured to allow visual verification of proper seating of the central conductor within the shield terminal.

6. The assembly according to claim 4, further comprising:

the coaxial cable which has the shield conductor surrounding a central conductor, wherein the shield conductor is connected to the shield terminal; and a central conductor terminal disposed within the inner insulator and connected to the central conductor.

7. A shielded electrical connector assembly, comprising:

a shield terminal formed of a first electrically conductive material having an attachment portion configured to attach to a shield conductor of a coaxial cable and a connection portion configured to be received within a mating shield terminal; and a contact cage formed of a second electrically conductive material having a forward band, a rearward band and a plurality of longitudinally arranged arcuate contact arms extending from the forward band to the rearward band, wherein the contact cage is slideably attached to the shield terminal by a tab extending from the forward band that is folded into an opening in the connection portion and by a cantilevered tab extending from a side wall of the connection portion, wherein the cantilevered tab is configured to inhibit forward motion of the rearward band.

8. The assembly according to claim 7, wherein the contact cage includes a plurality of tabs extending from the forward band that are folded into the opening in the connection portion and wherein folded regions of the plurality of tabs have a rounded shape.

9. The assembly according to claim 7, further comprising an inner insulator disposed within the shield terminal, wherein the side wall of the connection portion defines an inspection aperture.

10. The assembly according to claim 9, wherein the plurality of tabs is a first plurality of tabs and wherein the contact cage includes a second plurality of tabs extending from the forward band that are folded into the inspection aperture.

11. The assembly according to claim 7, wherein the contact cage has a generally cylindrical shape and wherein a first gap is defined in the forward band and a second gap is defined in the rearward band.

12. The assembly according to claim 11, wherein the first gap is longitudinally aligned with the second gap.

13. A method of forming a shielded electrical connector assembly, comprising the steps of:

cutting a shield terminal preform from a first sheet of electrically conductive material;

forming the shield terminal preform into a shield terminal having an attachment portion configured to attach to a shield conductor of a coaxial cable and a connection portion configured to be received within a mating shield terminal;

forming a cantilevered tab extending from a side wall of the connection portion;

cutting a contact cage preform from a second sheet of electrically conductive material;

forming the contact cage preform into a contact cage having a forward band, a rearward band, a plurality of longitudinally arranged arcuate contact arms extending from the forward band to the rearward band, and a first plurality of tabs extending from the forward band; and slideably attaching the contact cage to the shield terminal by folding the first plurality of tabs into an opening in the connection portion and sliding the rearward band past the cantilevered tab.

14. The method according to claim 13, wherein folded regions of the first plurality of tabs have a rounded shape.

15. The method according to claim 14, further comprising the step of forming an inspection aperture in the side wall of the connection portion.

16. The method according to claim 15, wherein the contact cage includes a second plurality of tabs extending from the forward band and wherein the method further comprises the step of folding the second plurality of tabs into the inspection aperture.

17. The method according to claim 13, wherein the contact cage is formed into a generally cylindrical shape and wherein a first gap is defined in the forward band and a second gap is defined in the rearward band.

18. The method according to claim 17, wherein the first gap is longitudinally aligned with the second gap.

19. The method according to claim 13, wherein compression of the plurality of contact arms causes the contact cage to extend rearwardly.

20. A method of interconnecting a shielded electrical connector assembly, comprising the steps of:

providing a shielded electrical connector including a shield terminal having an attachment portion configured to be connected to a shield conductor of a first coaxial cable and a connection portion, the shielded electrical connector further including a contact cage surrounding a forward segment of the connection portion and slideably attached to the shield terminal, wherein the contact cage defines a plurality of arcuate contact arms;

providing a mating shielded electrical connector having a mating shield terminal configured to receive the connection portion of the shield terminal;

inserting the connection portion of the shield terminal into the mating shield terminal such that the plurality of arcuate contact arms are in intimate compressive contact with a mating shield terminal inner wall, wherein the compressive contact of the plurality of arcuate contact arms with the mating shield terminal inner wall causes the contact cage to extend rearwardly when the shield terminal is inserted within the mating shield terminal.

* * * * *